United States Patent [19]

McGroarty et al.

[11] Patent Number: 4,598,177

[45] Date of Patent: Jul. 1, 1986

[54] HEARING AID WITH SELF-CONTAINED BATTERY COMPARTMENT AND VOLUME CONTROL

[75] Inventors: Joseph F. McGroarty, Chicago, Ill.; Thomas D. Houlihan, Plymouth, Minn.

[73] Assignee: Sears, Roebuck, & Co., Chicago, Ill.

[21] Appl. No.: 692,068

[22] Filed: Jan. 16, 1985

[51] Int. Cl.[4] ..... H04R 25/02

[52] U.S. Cl. ..... 179/107 E; 381/69

[58] Field of Search ..... 179/107 E, 107 R, 179, 179/187 R; 381/69; 181/129, 130

[56] References Cited

U.S. PATENT DOCUMENTS

| | | | |
|---|---|---|---|
| Re. 26,174 | 3/1967 | Leale | 179/107 E |
| D. 201,969 | 8/1965 | Geib | D26/14 |
| D. 206,162 | 11/1966 | Geib et al. | D26/14 |
| D. 206,228 | 11/1966 | Strzalkowski | D26/14 |
| D. 206,665 | 1/1967 | Sanzone | D26/14 |
| D. 207,205 | 3/1967 | Geib | D26/14 |
| D. 213,006 | 12/1968 | Giller | D26/14 |
| D. 213,007 | 12/1968 | Giller | D26/14 |
| D. 213,109 | 1/1969 | Young | D26/14 |
| D. 213,448 | 3/1969 | Giller | D26/14 |
| D. 219,983 | 2/1971 | Bosch et al. | D26/14 |
| D. 273,707 | 5/1984 | McCall | D24/35 |
| 1,556,775 | 10/1925 | Fensky | 181/130 |
| 1,893,143 | 1/1933 | Koch | 181/135 |
| 2,312,534 | 3/1943 | Fiene | 181/135 |
| 2,325,590 | 8/1943 | Carlisle et al. | 179/107 E |
| 2,634,337 | 4/1953 | Bland | 179/107 E |
| 2,950,357 | 8/1960 | Mitchell et al. | 179/107 E |
| 2,959,645 | 11/1960 | Ladd | 179/107 E |
| 3,031,537 | 4/1962 | Rose | 179/107 H |
| 3,045,073 | 7/1962 | Vickerson | 179/107 H |
| 3,047,089 | 7/1962 | Zwislocki | 181/135 |
| 3,055,990 | 9/1962 | Sidlo | 179/107 E |
| 3,197,576 | 7/1965 | Martin | 179/107 E |
| 3,312,789 | 4/1967 | Lewis et al. | 179/107 R |
| 3,345,737 | 10/1967 | Gordon | 29/527.1 |
| 3,496,306 | 2/1970 | Pollak | 179/107 R |
| 3,529,102 | 9/1970 | Rosenstand | 179/107 E |
| 3,542,973 | 11/1970 | Bosch et al. | 179/107 E |
| 3,548,116 | 12/1970 | Schafft | 179/110 A |
| 3,598,928 | 8/1971 | Hickox | 179/107 E |
| 3,688,053 | 8/1972 | Bosch et al. | 179/107 E |
| 3,702,123 | 11/1972 | Macken et al. | 181/135 |
| 3,783,201 | 1/1974 | Weiss et al. | 179/107 E |
| 3,787,643 | 1/1974 | Nielsen | 179/107 E |
| 3,800,101 | 3/1974 | Milani | 179/107 E |
| 3,852,540 | 12/1974 | Diethelm | 179/107 E |
| 3,865,998 | 2/1975 | Weiss et al. | 179/107 E |
| 4,069,400 | 1/1978 | Johanson et al. | 179/107 E |
| 4,272,591 | 6/1981 | Brander | 429/98 |
| 4,291,203 | 9/1981 | Bellafiore | 179/107 E |
| 4,375,016 | 2/1983 | Harada | 179/182 R |

OTHER PUBLICATIONS

The Hearing Journal, vol. 37, No. 1, Jan. 1984, (pp. 2, 6, 11, 18, 23–36).

Advertisement of Telex Communications, Inc. for: "28 Series", May, 1982.

Advertisement of Finetone Hearing Instruments, Inc. for: "The Right Stuff at the Right Price", (no date).

*Primary Examiner*—Gene Z. Rubinson

*Assistant Examiner*—Danita R. Byrd

*Attorney, Agent, or Firm*—Wood, Dalton, Phillips, Mason & Rowe

[57] ABSTRACT

A hearing aid of the self-contained type. The hearing aid includes a unitary housing shaped for insertion into an ear of a wearer. The housing has a face plate adapted to face outwardly of the ear of the wearer. A first opening is provided in the face plate to form a battery compartment. The battery compartment normally is concealed by a pivotable door movable from a closed position to an open position providing access to the battery compartment. A wheel mounting cavity is also provided within the unitary housing in laterally spaced relation to the battery compartment. The cavity is defined in part by an outer wall integral with the end plate. A second opening is provided in the face plate to form a volume control wheel compartment. The compartment is disposed between the battery compartment and the wheel mounting cavity and is in communication with the wheel mounting cavity. A volume control wheel is disposed in the volume control wheel compartment for rotational movement. The wheel is mounted on supporting structure rigidly secured within the wheel mounting cavity and extending into the volume control wheel compartment. The hearing aid also includes at least a portion of the outermost peripheral extent of the volume control wheel projecting above the pivotable door and the outer wall. With this construction, the volume control wheel is adapted for manipulation by a finger of the wearer.

38 Claims, 8 Drawing Figures

HEARING AID WITH SELF-CONTAINED BATTERY COMPARTMENT AND VOLUME CONTROL

BACKGROUND OF THE INVENTION

The present invention generally relates to hearing aids and, more particularly, to hearing aids of the self-contained type.

Over the past few years, there has been a rapidly growing demand for self-contained hearing aids, i.e., in-the-ear and canal aids. In particular, canal aids have grown in popularity in large measure because of cosmetic appeal since canal aids are barely visible when worn. In fact, experience has shown that canal aids are popular regardless of age, sex or socioeconomic considerations.

Unfortunately, while the cosmetic appeal is self-evident, the technological problems of providing a high-quality device have proven to be quite formidable. Despite the problems, however, the quality of canal aids has advanced faster than that of any type of product in the history of the hearing aid industry. Nevertheless, the technological problems still must be overcome if canal aids are to achieve a level of performance that is fully satisfactory.

Due to the obvious size constraints in canal aids, the operational components must be quite miniaturized. The growth of miniaturized electronic components has largely met this demand, but the mechanical components such as the battery access and volume control have oftentimes been inadvertently damaged by the wearer due to the lack of sufficient structural support. As a result, these components can be damaged or destroyed in normal use resulting in unnecessary inconvenience and customer complaints.

In particular, the volume control in most canal aids is disposed in a plane which extends perpendicular to the longitudinal direction of the ear canal of the wearer. This type of volume control has caused problems because, when the wearer attempts to adjust the volume, the canal aid may inadvertently be lodged dangerously deep in the ear canal by reason of the fact that the wearer's finger bears against the end of the canal aid and must necessarily apply some force to the volume control in order to adjust the volume. To overcome this problem, manufacturers have attempted to limit the amount of force required to rotate the control for volume adjustment.

Unfortunately, in order to reduce the force required to adjust the volume, the volume control mounting has been made less substantial. This, in turn, has resulted in the volume control being easily damaged by the wearer, and it has also been found that reduction of the resistances to rotation of the volume control has not significantly reduced the incidents of lodging the canal aid dangerously deep in the ear canal since this is easily done with conventional canal aids regardless of the ease with which the volume control can be rotated. As a result, it has remained to provide a self-contained hearing aid that overcomes the problems in a fully satisfactory manner.

SUMMARY OF THE INVENTION

Accordingly, the present invention is directed to an improved hearing aid of the self-contained type. The hearing aid includes a unitary housing shaped for insertion into an ear of a wearer. The housing has a face plate adapted to face outwardly of the ear of the wearer. A first opening is provided in the face plate to form a battery compartment. The battery compartment normally is concealed by a pivotable door movable from a closed position to an open position providing access to the battery compartment. A wheel mounting cavity is also provided within the unitary housing in laterally spaced relation to the battery compartment. The cavity is defined in part by an outer wall integral with the end plate. A second opening is provided in the face plate to form a volume control wheel compartment. The compartment is disposed between the battery compartment and the wheel mounting cavity and is in communication with the wheel mounting cavity. A volume control wheel is disposed in the volume control wheel compartment for rotational movement. The wheel is mounted on support means rigidly secured within the wheel mounting cavity and extending into the volume control wheel compartment. The hearing aid also includes at least a portion of the outermost peripheral extent of the volume control wheel projecting above the pivotable door and the outer wall. With this construction, the volume control wheel is adapted for manipulation by a finger of the wearer.

In a preferred embodiment, the operational components, when the hearing aid is in the ear of the wearer, are generally vertically oriented. In particular, the hearing aid includes a vertically extending battery compartment normally concealed by a vertically extending pivotable door, a generally vertical wheel mounting cavity in spaced parallel relation to the battery compartment which is defined in part by a vertically extending outer wall, a vertically extending volume control wheel compartment in communication with the wheel mounting cavity and the battery compartment, and a volume control wheel disposed in a generally vertical orientation in adjacent parallel relation to the battery compartment and the wheel mounting cavity which is mounted for rotation in response to generally up and down movement or manipulation by a finger of the wearer. With this feature, the hearing aid is far less likely to be lodged dangerously deep in the ear canal.

Additional features of the present invention include the wheel mounting cavity having a mounting surface within the housing. The support means for the volume control wheel then preferably includes a plate adapted to be rigidly secured to the mounting surface and a hub adapted to be rigidly secured to the plate. With this arrangement, the volume control wheel is mounted on the hub by means of a circumferential flange for rotational movement about the hub.

More specifically, the volume control wheel includes an axially extending circumferential flange adapted to cooperate with the hub. The flange is preferably of a lesser diameter than the remainder of the wheel. Also, the flange is preferably of a width sufficient to extend from the volume control wheel compartment into the wheel mounting cavity.

As for the volume control wheel, the outer surface preferably includes a plurality of circumferentially spaced upstanding ribs. At least the ribs preferably comprise the portion of the outermost peripheral extent of the wheel projecting above the pivotable door and the outer wall defining the wheel mounting cavity. With these features of construction, the ribs may easily be manipulated by a finger of the wearer to effect rotational movement of the wheel.

In addition, the pivotable door is preferably arcuate in shape and includes hinge means associated with one end thereof and latch means associated with the other end thereof. The face plate then advantageously includes a generally arcuate upstanding wall adjacent the battery compartment which is disposed on the side thereof remote from the volume control wheel and generally conforms in shape to the generally arcuate pivotable door. Another feature includes the pivotable door having lift means adjacent the latch means for moving the pivotable door from the closed position to the open position.

In the preferred embodiment, the lift means includes a finger extending from the pivotable door in the closed position in closely spaced relation to the face plate of the housing. It is also advantageous for the pivotable door to include an integral battery holder which is movable from a position within the battery compartment when the door is in the closed position to a position externally of the housing when the door is in the open position. In addition, the battery holder is preferably generally circular in shape and includes a flat depending side wall disposed at the juncture between the battery compartment and the volume control wheel compartment.

With this arrangement, the volume control wheel compartment preferably comprises a continuation of the battery compartment extending laterally from one side thereof. The volume control wheel then advantageously includes a generally circular disc shaped portion disposed generally at the juncture between the first and second openings in juxtaposition to the flat depending side wall of the battery holder with only the outermost peripheral extent of the volume control wheel projecting slightly above the pivotable door and the outer wall. By reason of the unique construction and arrangement of the structural components, the present invention provides a self-contained hearing aid which is structurally sound.

These and other objects, features and advantages of the present invention will become apparent from the following description when considered in connection with the accompanying drawings.

DETAILED DESCRIPTION OF THE PREFERRED EMBODIMENT

Figure 1:
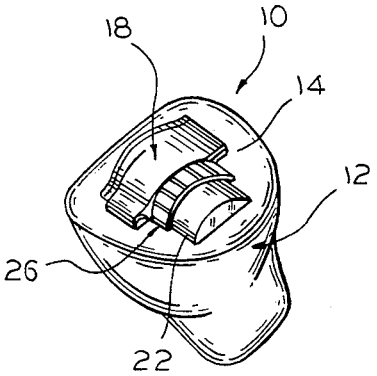
FIG. 1 is a perspective view of a self-contained hearing aid in accordance with the present inventions.

Referring to the drawings, and first to FIG. 1, the reference numeral 10 designates generally a self-contained hearing aid in accordance with the present invention. The hearing aid 10 includes a unitary housing 12 shaped for insertion into an ear of a wearer. The housing 12 has a face plate 14 adapted to face outwardly of the ear of the wearer. A first opening 16 is provided in the face plate 14 defining a battery compartment (see FIG. 5). The battery compartment 16 is normally concealed by a pivotable door 18 movable from a closed position to an opening position providing access to the battery compartment 16 (see FIG. 8). A wheel mounting cavity 20 is also provided within the unitary housing 12 in laterally spaced relation to the battery compartment 16 (see FIG. 3). The cavity 20 is defined in part by an outer wall 22 integral with the end plate 14 (see FIG. 3). A second opening 24 is provided in the face plate 14 defining a volume control wheel compartment (see FIG. 5). The compartment 24 is disposed between the battery compartment 16 and the wheel mounting cavity 20 and is in communication with the wheel mounting cavity 20 (see FIG. 3). A volume control wheel 26 is disposed in the volume control wheel compartment 24 for rotational movement (see FIG. 7). The wheel 26 is mounted on support means rigidly secured within the wheel mounting cavity 20 and extending into the volume control wheel compartment 24. With this arrangement, the volume control wheel 26 is adapted for manipulation by a finger of the wearer.

As will be seen by referring to FIG. 1, the wheel 26 has at least a portion thereof projecting above the face plate 14. It will also be appreciated that the pivotal door 18 concealing the battery compartment 16 projects above the face plate 14 on one side of the volume control wheel 26 and the outer wall 22 defining the wheel mounting cavity 20 projects above the face plate 14 on the other side of the volume control wheel 26. Moreover, the volume control wheel 26 has at least a portion **26*a* of its outermost peripheral extent projecting above the pivotable door 18 and the outer wall 22 (see FIG. 3**).

Figure 5:
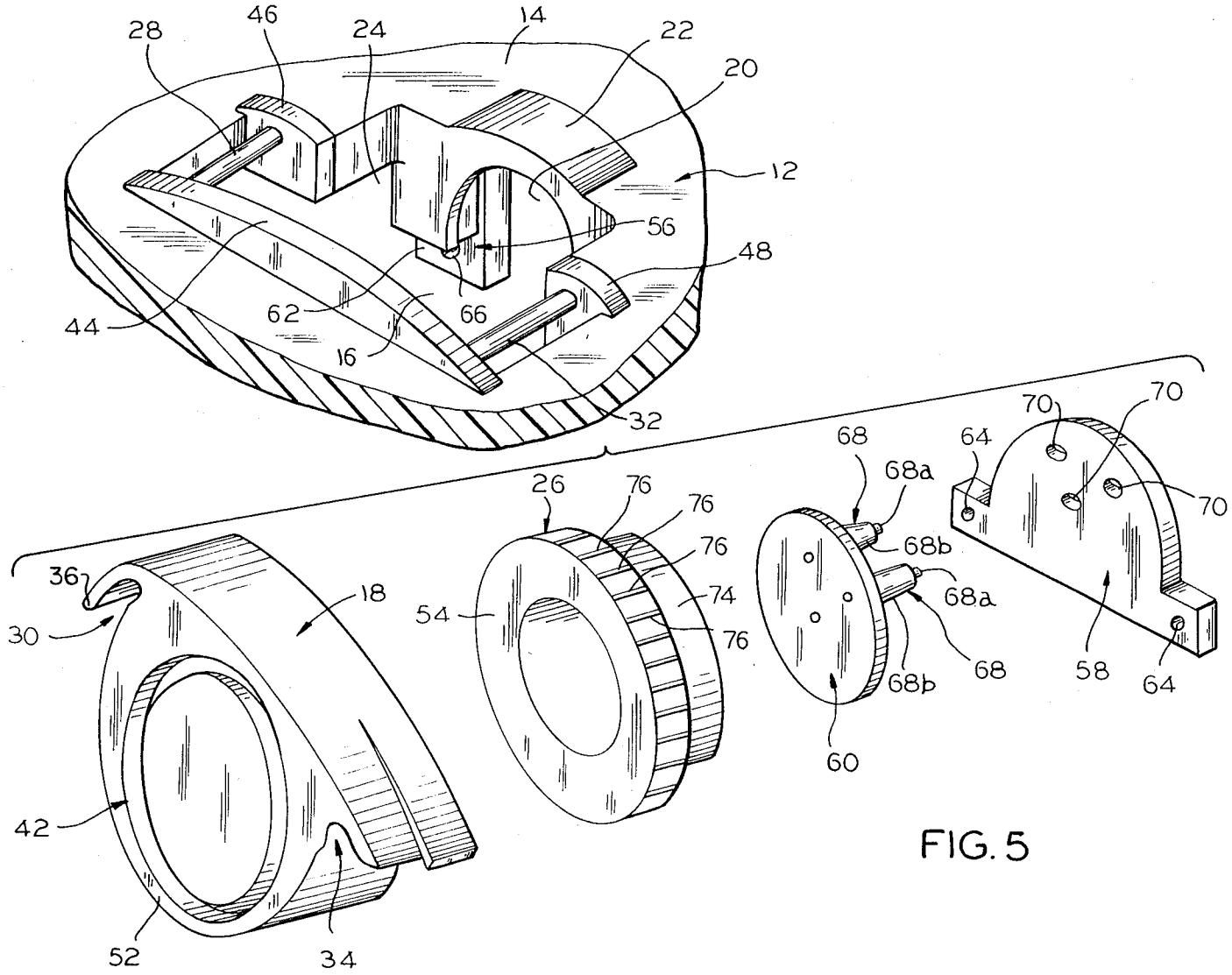
FIG. 5 is an exploded perspective view of the operational components of the hearing aid illustrated in FIG. 1.

Referring to FIG. 5, the pivotable door 18 is generally arcuate in shape. The door 18 has hinge means associated with one end thereof including a hinge pin 28 spanning the first opening 16 in the face plate 14. The hinge pin 28 is secured to the face plate 14 on opposite sides of the first opening 16. In addition, the hinge means includes a slot 30 in the pivotable door 18 adapted to receive the hinge pin 28 in snap fit relation. The door 18 also has latch means associated with the other end thereof including a latch pin 32 spanning the first opening 16 in the face plate 14. The latch pin 32 is secured to the face plate 14 on opposite sides of the first opening 16. Moreover, the latch means also includes a slot 34 in the pivotable door 18 adapted to receive the latch pin 32 in snap fit relation.

Figure 4:
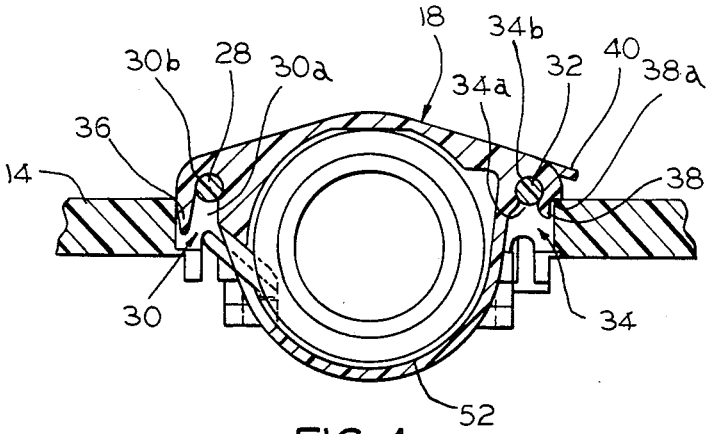
FIG. 4 is a cross-sectional view taken on the line 4—4 of FIG. 2.

Referring to FIGS. 4 and 5, the slot 30 disposed in the underside of the door 18 is defined in part by a downwardly projecting tongue 36 adapted to extend into the first opening 16 in the face plate 14. It will be seen that the tongue 36 engages the face plate 14 adjacent the hinge pin 28. The slot 30 includes a pin guiding portion **30*a* adapted to receive the hinge pin 28. It will also be seen that the pin guiding portion 30*a* leads to a generally circular pin gripping portion 30*b* having a generally equal diameter to the hinge pin 28. The pin gripping portion 30*b* cooperates with the hinge pin 28 for hinge-like movement of the pivotable door 18 between the open and closed positions. It will also be seen that the pin guiding portion 30*a* tapers toward the pin gripping portion 30*b*. As will be appreciated, the pin guiding portion 30***a* has a maximum width greater than the diameter of the hinge pin 28 remote from the pin gripping portion 30*b* and has a minimum width less than the diameter of the hinge pin 28 adjacent the pin gripping portion 30*b* to provide a restricted entrance into the generally circular pin gripping portion 30*b* to achieve the snap fit described hereinabove.

Still referring to FIGS. 4 and 5, the slot 34 also disposed in the underside of the pivotable door 18 is defined in part by a downwardly extending lip 38 adapted to extend into the first opening 16 in the face plate 14. It will be seen that the lip 38 includes a shoulder 38*a* adapted to rest upon the face plate 14 at the end of the first opening 16 adjacent the latch pin 32. The slot 34 includes a pin guiding portion 34*a* adapted to receive the latch pin 32. It will also be seen that the pin guiding portion 34*a* leads to a generally circular pin engaging portion 34*b* having a generally equal diameter to the latch pin 32. The pin engaging portion 34*b* cooperates with the latch pin 32 for releasably latching the pivotable door 18 in the closed position. It will also be seen that the pin guiding portion 34*a* tapers toward the pin engaging portion 34*b*. As shown, the pin guiding portion 34*a* has a maximum width greater than the diameter of the latch pin 32 remote from the pin engaging portion 34*b* and has a minimum width less than the diameter of the latch pin 32 adjacent the pin engaging portion 34*b* to provide a restricted entrance into the generally circular pin engaging portion 34*b* to achieve the releasable latch described hereinabove.

Still referring to FIGS. 4 and 5, the pivotable door 18 includes lip means, preferably finger 40, adjacent the latch means. The finger 40 extends from the pivotable door 18 in the closed position thereof in closely spaced relation to the face plate 14 of the housing 12 for moving the pivotable door 18 from the closed position to the open position. A battery holder 42 is also integrally associated with the pivotable door 18. The battery holder 42 is movable from a position within the battery compartment 16 when the pivotable door 18 is in the closed position to a position externally of the housing 12 when the pivotable door 18 is in the open position. As shown, the battery holder 42 is preferably generally circular in shape to receive a circular battery 43 (see FIG. 3).

Figure 6:
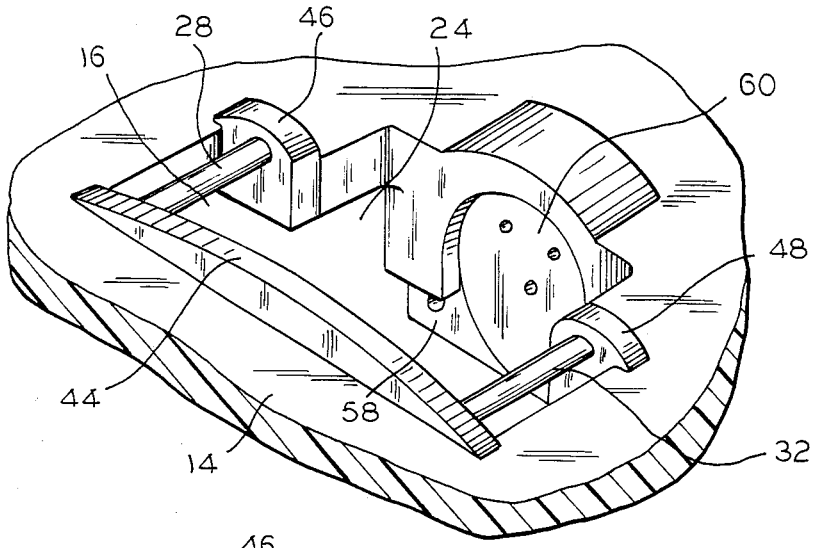
FIG. 6 is a perspective view of the hearing aid in a partially assembled condition.
Figure 7:
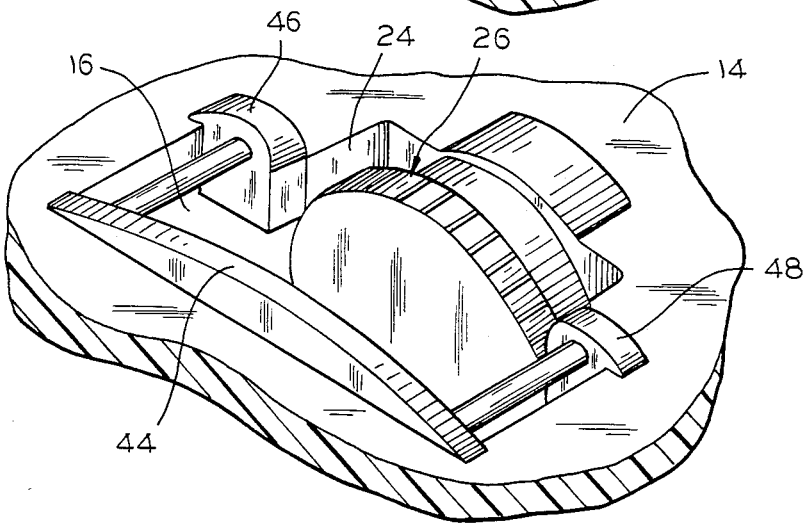
FIG. 7 is a perspective view of the hearing aid in a further assembled condition.
Figure 8:
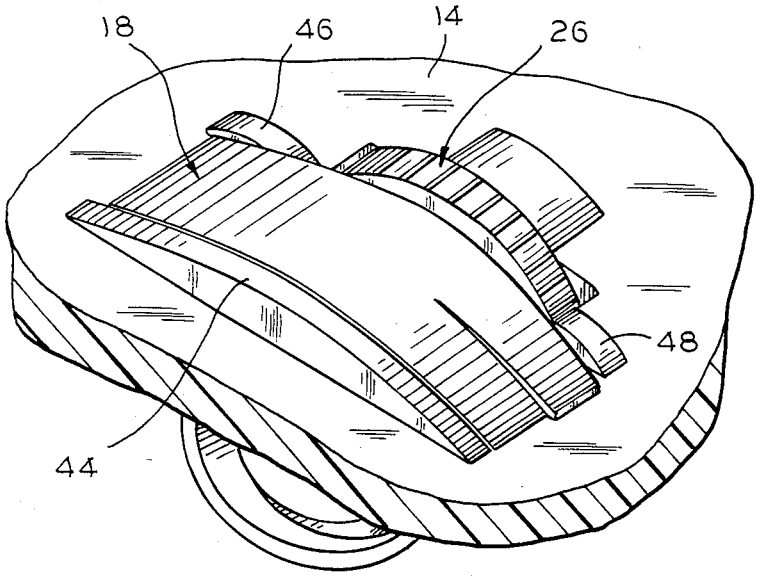
FIG. 8 is a perspective view in a fully assembled condition.

As shown in FIGS. 6 through 8, the face plate 14 preferably includes a generally arcuate upstanding wall 44 adjacent the first opening 16. The wall 44 is disposed on the side of the first opening 16 remote from the volume control wheel 26 and generally conforms in shape to the generally arcuate pivotable door 18. The face plate 14 also includes a pair of lugs 46 and 48 adjacent the first opening 16 and disposed on the side of the first opening 16 adjacent the volume control wheel 26. As shown, one of the lugs 46 is disposed at one end of the first opening 16 and the other of the lugs 48 is disposed at the other end of the first opening 16.

Still referring to FIGS. 6 through 8, the hinge pin 28 extends from the lug 46 to the upstanding wall 44. It will also be seen that the latch pin 32 extends from the lug 48 to the upstanding wall 44. Finally, the lugs 46 and 48 are curved to generally conform in shape to the pivotable door 18.

Referring to FIG. 5, the second opening 24 preferably comprises a laterally extending continuation of the first opening 16. It will then be seen by referring to FIG. 3 that the battery holder 42 may be defined in part by a flat depending side wall 50 and a generally arcuate bottom wall 52 (see also FIG. 4) where the side wall 50 is disposed at the juncture between the first and second openings 16 and 24. Also as shown in FIG. 5, the volume control wheel 26 preferably includes a generally circular disc shaped portion 54 adjacent the flat depending side wall 50 of the battery holder 42.

As shown in FIG. 5, the wheel mounting cavity 20 includes a mounting surface 56 within the housing 12. The support means for the volume control wheel 26 then includes a plate 58 adapted to be rigidly secured to the mounting surface 56 and a hub 60 adapted to be rigidly secured to the plate 58. With this arrangement, the volume control wheel 26 may be mounted on the hub 60 for rotational movement.

Still referring to FIG. 5, the mounting surface 56 preferably includes a pair of spaced apart integral walls. It will be appreciated that only one of the walls 52 is illustrated in the drawing for purposes of clarity although an identical wall will be provided on the other side of the cavity 20 and the walls (such as 62) extend from the face plate 14 interiorly of the housing 12 and generally at opposite ends of the outer wall 22 defining the wheel mounting cavity 20. As will be appreciated, the plate 58 and the walls 62 include aligned openings 64 and 66, respectively, for utilizing fastener means (not shown) to rigidly secure the plate 58 to the walls 62.

Also as shown, the hub 60 includes a plurality of axially extending fasteners 68. The plate 58 then includes a plurality of correspondingly aligned holes 70 adapted to receive and cooperate with the fasteners 68. With this arrangement, the fasteners 68 are adapted to rigidly secure the hub 60 to the plate 58.

Figure 3:
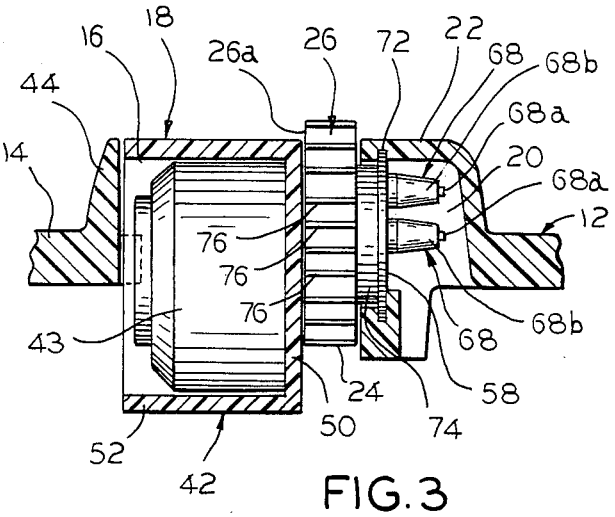
FIG. 3 is a cross-sectional view taken on the line 3—3 of FIG. 2.

As shown in FIG. 3, the wheel mounting cavity 20 preferably includes a groove 72 in the underside of the outer wall 22. The plate 58 is then correspondingly sized and shaped (as shown) to be disposed within the groove 72. With the cooperation of the plate 58 within the groove 72, and the cooperation of the hub 60 with the plate 58, the supporting structure for the volume control wheel 26 is quite strong.

Referring now to FIGS. 3 and 5, the volume control wheel 26 includes an axially extending circumferential flange 74 adapted to cooperate with the hub 60. The flange 74 is of lesser diameter than the remainder of the wheel 26. However, the flange 74 is of a width sufficient to extend from the volume control wheel compartment 24 into the wheel mounting cavity 20.

Finally, the outer surface of the remainder of the volume control wheel 26 includes a plurality of axially extending, circumferentially spaced upstanding ribs 76. At least the ribs 76 on the wheel portion 26*a* at any one time comprising the outermost peripheral extent of the wheel 26 project above the pivotable door 18 and the outer wall 22. As will be appreciated, the ribs 76 are adapted for manipulation by a finger of the wearer to effect rotational movement of the wheel.

Referring to FIG. 1, it will be apparent to those skilled in the art that the structural components, when the hearing aid 10 is in the ear of the wearer, are generally vertically oriented. In particular, the hearing aid 10 includes a vertically extending battery compartment 16 normally concealed by a vertically extending pivotable door 18, a generally vertical wheel mounting cavity 20 in spaced parallel relation to the battery compartment 16 which is defined in part by a vertically extending outer wall 22, a vertically extending volume control wheel compartment 24 in communication with the wheel mounting cavity 20 and the battery compartment 16, and a volume control wheel 26 disposed in a generally vertical orientation in adjacent parallel relation to the battery compartment 16 and the wheel mounting cavity 20 which is mounted for rotation in response to up and down movement or manipulation by a finger of the wearer. With this feature, it is quite unlikely for the hearing aid 10 to be lodged dangerously deep in the ear canal.

As will be appreciated, the hearing aid 10 of the present invention can utilize any available electronic components suited for use in such devices. These components have, therefore, been omitted from the drawing. In addition, the materials used in the hearing aid 10 can be selected from among those conventionally available from time to time.

Referring to FIGS. 6 through 8, the hearing aid 10 is illustrated in various stages of assembly. FIG. 6 illustrates the hub 60 mounted on the plate 58 within the wheel mounting cavity 20. FIG. 7 illustrates the volume control wheel 26 within the volume control wheel compartment 24 mounted on the hub 60. FIG. 8 illustrates the pivotable door 18 mounted on the hinge pin 28 and latch pin 32 over the battery compartment 16. As will be appreciated, the structural components are in a fully assembled condition in FIG. 8.

Figure 2:
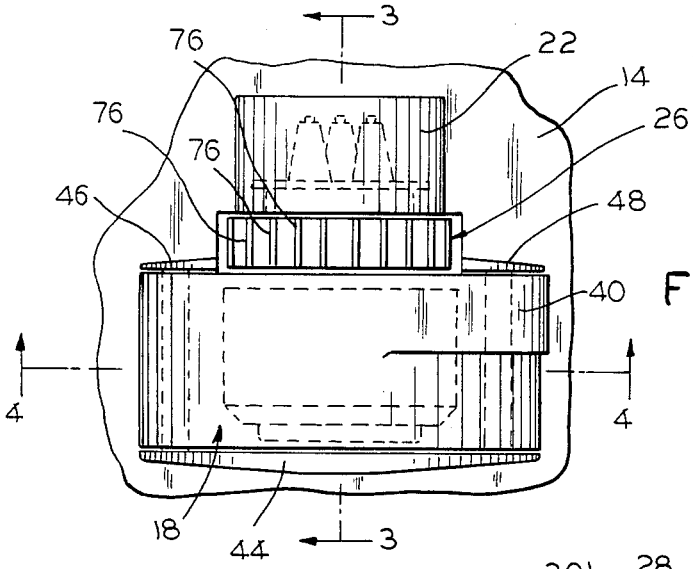
FIG. 2 is an enlarged top plan view of the operational components of the hearing aid illustrated in FIG. 1.

Referring to FIG. 2, the relative orientation of the structural components can be appreciated where the volume control wheel 26 is disposed between the outer wall 22 defining the wheel mounting cavity 20 and the pivotable door 18 in closely spaced, juxtaposed relation. By referring to FIG. 3, it will be seen that only the outermost peripheral extent 26*a* projects above the pivotable door 18 and the outer wall 22, and then only by a very slight amount sufficient for manipulation by a finger of the wearer to effect rotational movement of the wheel 26. With the flat depending side wall 50 next to the generally circular disc-shaped portion 54, and because of the rigid mounting of the volume control wheel 26 within the wheel mounting cavity, the operational components of the self-contained hearing aid 10 are virtually immune from damage.

In addition, the volume control wheel 26 is disposed in a generally vertical plane in the ear of the wearer. This orientation requires manipulation by the wearer's finger in an up and down direction in contrast to most canal aids in which the volume control is disposed in a plane which extends perpendicular to the longitudinal direction of the ear canal of the wearer. As a result, the hearing aid 10 is far less likely to be inadvertently lodged dangerously deep in the ear canal.

Various changes coming within the spirit of the present invention may suggest themselves to those skilled in the art. Hence, it will be understood that the invention is not to be limited to the specific embodiment shown and described or the uses mentioned. On the contrary, the present invention is limited only by the scope of the appended claims.

We claim:

1. In a hearing aid of the self-contained type, the improvement comprising:

a unitary housing shaped for insertion into an ear of a wearer, said housing having a face plate adapted to face outwardly of the ear of the wearer;

a first opening in said face plate defining a battery compartment, said battery compartment normally being concealed by a pivotable door movable from a closed position to an open position, said door in said open position providing access to said battery compartment;

a wheel mounting cavity within said unitary housing in laterally spaced relation to said battery compartment, said cavity being defined in part by an outer wall integral with said end plate;

a second opening in said face plate defining a volume control wheel compartment, said compartment being disposed between said battery compartment and said wheel mounting cavity, said compartment being in communication with said wheel mounting cavity; and a volume control wheel disposed in said volume control wheel compartment, said wheel being mounted for rotational movement by support means rigidly secured within said wheel mounting cavity and extending into said volume control wheel compartment, said wheel having at least a portion thereof projecting above said face plate;

said pivotable door concealing said battery compartment projecting above said face plate on one side of said volume control wheel, said outer wall defining said wheel mounting cavity projecting above said face plate on the other side of said volume control wheel, said volume control wheel having at least a portion of its outermost peripheral extent projecting above said pivotable door and said outer wall;

whereby said volume control wheel is adapted for manipulation by a finger of the wearer.

2. The hearing aid as defined by claim 1 wherein said pivotable door is generally arcuate in shape, said door including hinge means associated with one end thereof, said door including latch means associated with the other end thereof.

3. The hearing aid as defined by claim 2 wherein said hinge means includes a hinge pin spanning said first opening in said face plate, said hinge pin being secured to said face plate on opposite sides of said first opening, said hinge means also including a slot in said pivotable door adapted to receive said hinge pin in snap fit relation.

4. The hearing aid as defined by claim 3 wherein said slot is disposed in the underside of said pivotable door, said slot being defined in part by a downwardly projecting tongue adapted to extend into said first opening in said face plate, said tongue engaging said face plate at the end of said first opening adjacent said hinge pin.

5. The hearing aid as defined by claim 3 wherein said slot includes a pin guiding portion adapted to receive said hinge pin, said pin guiding portion leading to a generally circular pin gripping portion, said pin gripping portion cooperating with said hinge pin for movement of said pivotable door.

6. The hearing aid as defined by claim 5 wherein said pin guiding portion tapers toward said pin gripping portion, said pin guiding portion having a maximum width greater than the diameter of said hinge pin remote from said pin gripping portion and having a width less than the diameter of said hinge pin adjacent said pin gripping portion to provide a restricted entrance into said pin gripping portion, said pin gripping portion being of generally equal diameter to said hinge pin.

7. The hearing aid as defined by claim 2 wherein said latch means includes a latch pin spanning said first opening in said face plate, said latch pin being secured to said face plate on opposite sides of said first opening, said latch means also including a slot in said pivotable door adapted to receive said latch pin in snap fit relation.

8. The hearing aid as defined by claim 7 wherein said slot is disposed in the underside of said pivotable door, said slot being defined in part by a downwardly extending lip adapted to extend into said first opening in said face plate, said lip including a shoulder adapted to rest upon said face plate at the end of said first opening adjacent said latch pin.

9. The hearing aid as defined by claim 8 wherein said slot includes a pin guiding portion adapted to receive said latch pin, said pin guiding portion leading to a generally circular pin engaging portion, said pin engaging portion cooperating with said latch pin for releaseably latching said pivotable door in said closed position.

10. The hearing aid as defined by claim 9 wherein said pin guiding portion tapers toward said pin engaging portion, said pin guiding portion having a maximum width greater than the diameter of said latch pin remote from said pin engaging portion and having a width less than the diameter of said latch pin adjacent said pin engaging portion to provide a restricted entrance into said pin engaging portion, said pin engaging portion being of generally equal diameter to said latch pin.

11. The hearing aid as defined by claim 2 wherein said face plate includes a generally arcuate upstanding wall adjacent said first opening, said wall being disposed on the side of said first opening remote from said volume control wheel, said wall generally conforming in shape to said generally arcuate pivotable door.

12. The hearing aid as defined by claim 11 wherein said face plate also includes a pair of lugs adjacent said first opening, said lugs being disposed on the side of said first opening adjacent said volume control wheel with one of said lugs being disposed at one end of said first opening and the other of said lugs being disposed at the other end of said first opening, and including a pin extending from each of said lugs to said upstanding wall.

13. The hearing aid as defined by claim 12 wherein one of said pins is a hinge pin and the other of said pins is a latch pin, said hinge pin being adapted to cooperate in hinge-like fashion with a slot at one end of said pivotable door and said latch pin being adapted to cooperate in latch-like fashion with a second slot at the other end of said pivotable door, said hinge pin and slot and said latch pin and said second slot comprising said hinge means and said latch means, respectively.

14. The hearing aid as defined by claim 2 wherein said pivotable door includes lip means integrally associated therewith adjacent said latch means, said lip means including a finger extending from said pivotable door in said closed position thereof in closely spaced relation to said face plate of said housing.

15. The hearing aid as defined by claim 1 including a battery holder integral with said pivotable door, said battery holder being movable from a position within said battery compartment when said pivotable door is in said closed position to a position externally of said housing when said pivotable door is in said open position, said battery holder being generally circular in shape.

16. The hearing aid as defined by claim 15 wherein said second opening comprises a laterally extending continuation of said first opening, said battery holder being defined in part by a flat depending side wall and a generally arcuate bottom wall, said side wall being disposed at the juncture between said first and second openings.

17. The hearing aid as defined by claim 16 wherein said volume control wheel includes a generally circular disc shaped portion disposed adjacent said flat depending side wall of said battery holder.

18. The hearing aid as defined by claim 1 wherein said wheel mounting cavity includes a mounting surface within said housing, said support means including a plate adapted to be rigidly secured to said mounting surface and a hub adapted to be rigidly secured to said plate, said volume control wheel being mounted on said hub for rotational movement.

19. The hearing aid as defined by claim 18 wherein said mounting surface includes a pair of spaced apart integral walls, said walls extending from said face plate interiorly of said housing and generally at opposite ends of said outer wall defining said wheel mounting cavity, said plate and said walls including aligned openings for utilizing fastener means to rigidly secure said plate to said walls.

20. The hearing aid as defined by claim 19 wherein said hub includes a plurality of axially extending fasteners, said plate including a plurality of holes adapted to receive and cooperate with said fasteners, said fasteners rigidly securing said hub to said plate.

21. The hearing aid as defined by claim 20 wherein said volume control wheel includes an axially extending circumferential flange adapted to cooperate with said hub, said flange being of lesser diameter than the remainder of said wheel, said flange being of a width sufficient to extend from said volume control wheel compartment into said wheel mounting cavity.

22. The hearing aid as defined by claim 21 wherein the outer surface of the remainder of said volume control wheel includes a plurality of circumferentially spaced upstanding ribs, at least said ribs comprising said portion of the outermost peripheral extent of said wheel projecting above said pivotable door and said outer wall, said ribs being adapted for manipulation by a finger of the wearer to effect rotational movement of said wheel.

23. The hearing aid as defined by claim 18 wherein said wheel mounting cavity includes a groove in the underside of said outer wall, said plate being adapted to be disposed within said groove, said plate and said mounting surface being rigidly secured by fastener means.

24. In a hearing aid of the self-contained type, the improvement comprising:

a unitary housing shaped for insertion into an ear of a wearer, said housing having a face plate adapted to face outwardly of the ear of the wearer;

a first generally vertical opening in said face plate defining a battery compartment, said battery compartment normally being concealed by a vertically extending pivotable door movable from a closed position to an open position, said door in said open position providing access to said battery compartment;

a generally vertical wheel mounting cavity within said unitary housing in spaced parallel relation to said battery compartment, said cavity being defined in part by a vertically extending outer wall integral with said end plate;

a second generally vertical opening in said face plate defining a volume control wheel compartment, said compartment extending vertically and being disposed between said battery compartment and said wheel mounting cavity, said compartment being in communication with said wheel mounting cavity and said battery compartment; and a generally vertical volume control wheel disposed in said volume control wheel compartment, said wheel being disposed in adjacent parallel relation to said battery compartment and said wheel mounting cavity and being mounted for rotation in response to up and down movement by support means rigidly secured within said wheel mounting cavity and extending into said volume control wheel compartment, said wheel having at least a portion thereof projecting above said face plate;

said pivotable door concealing said battery compartment projecting above said face plate on one side of said volume control wheel, said outer wall defining said wheel mounting cavity projecting above said face plate on the other side of said volume control wheel, said volume control wheel having at least a portion of its outermost peripheral extent projecting above said pivotable door and said outer wall;

whereby said volume control wheel is adapted for manipulation by a finger of the wearer.

25. The hearing aid as defined by claim 24 wherein said wheel mounting cavity includes a mounting surface within said housing, said support means including a plate adapted to be rigidly secured to said mounting surface and a hub adapted to be rigidly secured to said plate, said volume control wheel being mounted on said hub for rotational movement.

26. The hearing aid as defined by claim 25 wherein said hub includes a plurality of axially extending fasteners, said plate including a plurality of holes adapted to receive said fasteners, said fasteners rigidly securing said hub to said plate.

27. The hearing aid as defined by claim 26 wherein said volume control wheel includes an axially extending circumferential flange adapted to cooperate with said hub, said flange being of a lesser diameter than the remainder of said wheel, said flange being of a width sufficient to extend from said volume control wheel compartment into said wheel mounting cavity.

28. The hearing aid as defined by claim 27 wherein the outer surface of the remainder of said volume control wheel includes a plurality of circumferentially spaced upstanding ribs, at least said ribs comprising said portion of the outermost peripheral extent of said wheel projecting above said pivotable door and said outer wall, said ribs being adapted for manipulation by a finger of the wearer to effect rotational movement of said wheel.

29. The hearing aid as defined by claim 24 wherein said pivotable door is generally arcuate in shape, said door including hinge means associated with one end thereof, said door including latch means associated with the other end thereof.

30. The hearing aid as defined by claim 29 wherein said face plate includes a generally arcuate upstanding wall adjacent said first opening, said wall being disposed on the side of said first opening remote from said volume control wheel, said wall generally conforming in shape to said generally arcuate pivotable door.

31. The hearing aid as defined by claim 30 wherein said pivotable door includes lift means adjacent said latch means, said lift means including a finger extending from said pivotable door in said closed position thereof in closely spaced relation to said face plate of said housing.

32. The hearing aid as defined by claim 31 including a battery holder integral with said pivotable door, said battery holder being movable from a position within said battery compartment when said pivotable door is in said closed position to a position externally of said housing when said pivotable door is in said open position, said battery holder being generally circular in shape.

33. The hearing aid as defined by claim 32 wherein said second opening comprises a continuation of said first opening extending laterally from one side thereof, said battery holder being defined in part by a flat depending side wall and a generally arcuate bottom wall, said side wall being disposed at the juncture between said first and second openings.

34. The hearing aid as defined by claim 33 wherein said volume control wheel includes a generally circular disc shaped portion disposed adjacent said flat depending side wall.

35. In a hearing aid of the self-contained type, the improvement comprising:

a unitary housing shaped for insertion into an ear of a wearer, said housing having a face plate adapted to face outwardly of the ear of the wearer;

a first opening in said face plate defining a battery compartment, said battery compartment normally being concealed by a pivotable door movable from a closed position to an open position, said door in said open position providing access to said battery compartment;

a wheel mounting cavity within said unitary housing in laterally spaced relation to said battery compartment, said cavity being defined in part by an outer wall integral with said end plate;

a second opening in said face plate defining a volume control wheel compartment, said compartment being disposed between said battery compartment and said wheel mounting cavity, said compartment being in communication with said wheel mounting cavity; and a volume control wheel disposed in said volume control wheel compartment, said wheel being mounted for rotational movement by support means rigidly secured within said wheel mounting cavity and extending into said volume control wheel compartment, said wheel having at least a portion thereof projecting above said face plate;

said pivotable door concealing said battery compartment projecting above said face plate on one side of said volume control wheel, said outer wall defining said wheel mounting cavity projecting above said face plate on the other side of said volume control wheel, said volume control wheel having at least a portion of its outermost peripheral extent projecting above said pivotable door and said outer wall;

the outer surface of said volume control wheel including a plurality of circumferentially spaced upstanding ribs, at least said ribs comprising said portion of the outermost peripheral extent of said wheel projecting above said pivotable door and said outer wall, said ribs being adapted for manipulation by a finger of the wearer to effect rotational movement of said wheel;

said pivotable door being generally arcuate in shape, said door including hinge means associated with one end thereof, said door including latch means associated with the other end thereof;

said face plate including a generally arcuate upstanding wall adjacent said first opening, said wall being disposed on the side of said first opening remote from said volume control wheel, said wall generally conforming in shape to said generally arcuate pivotable door;

said pivotable door including lift means integrally associated therewith adjacent said latch means, said lift means including a finger extending from said pivotable door in said closed position thereof in closely spaced relation to said face plate of said housing;

said pivotable door having a battery holder integral therewith, said battery holder being movable from a position within said battery compartment when said pivotable door is in said closed position to a position externally of said housing when said pivotable door is in said open position, said battery holder being generally circular in shape;

said second opening comprising a continuation of said first opening extending laterally from one side thereof, said battery holder being defined in part by a flat depending side wall and a generally arcuate bottom wall, said side wall being disposed at the juncture between said first and second openings;

said volume control wheel including a generally circular disc shaped portion disposed adjacent said flat depending side wall.

36. The hearing aid as defined by claim 35 wherein said wheel mounting cavity includes a mounting surface within said housing, said support means including a plate adapted to be rigidly secured to said mounting surface and a hub adapted to be rigidly secured to said plate, said volume control wheel being mounted on said hub for rotational movement.

37. The hearing aid as defined by claim 36 wherein said hub includes a plurality of axially extending fasteners, said plate including a plurality of holes adapted to receive said fasteners, said fasteners rigidly securing said hub to said plate.

38. The hearing aid as defined by claim 37 wherein said volume control wheel includes an axially extending circumferential flange adapted to cooperate with said hub, said flange being of a lesser diameter than the remainder of said wheel, said flange being of a width sufficient to extend from said volume control wheel compartment into said wheel mounting cavity.

* * * * *